US011938535B2

(12) United States Patent
Thuo et al.

(10) Patent No.: US 11,938,535 B2
(45) Date of Patent: Mar. 26, 2024

(54) TEXTURED PARTICLES

(71) Applicant: Iowa State University Research Foundation, Inc., Ames, IA (US)

(72) Inventors: Martin Thuo, Ames, IA (US); Boyce S. Chang, Ames, IA (US); Andrew Martin, Ames, IA (US); Winnie M. Kiarie, Hillsboro, OR (US)

(73) Assignee: Iowa State University Research Foundation, Inc., Ames, IA (US)

( * ) Notice: Subject to any disclaimer, the term of this patent is extended or adjusted under 35 U.S.C. 154(b) by 37 days.

(21) Appl. No.: 17/527,064

(22) Filed: Nov. 15, 2021

(65) Prior Publication Data

US 2022/0152698 A1 May 19, 2022

Related U.S. Application Data

(60) Provisional application No. 63/115,951, filed on Nov. 19, 2020.

(51) Int. Cl.
*B22F 1/065* (2022.01)
*B22F 1/16* (2022.01)

(52) U.S. Cl.
CPC ..... *B22F 1/065* (2022.01); *B22F 1/16* (2022.01); *B22F 2201/01* (2013.01); *B22F 2301/20* (2013.01)

(58) Field of Classification Search
CPC ..... B22F 1/065; B22F 1/16; B22F 2201/01; B22F 2301/20; B22F 2999/00; B22F 1/145; B22F 1/17
See application file for complete search history.

(56) References Cited

U.S. PATENT DOCUMENTS

| | | | | |
|---|---|---|---|---|
| 10,124,310 | B2 | 11/2018 | Thuo et al. | |
| 10,293,325 | B2 | 5/2019 | Thuo et al. | |
| 2017/0014958 | A1 | 1/2017 | Thou et al. | |
| 2020/0269315 | A1* | 8/2020 | Dobashi | B22F 1/06 |
| 2022/0023940 | A1* | 1/2022 | Thuo | C22C 12/00 |

(Continued)

OTHER PUBLICATIONS

Cinar, S., et al., "Mechanical Fracturing of Core-Shell Undercooled Metal Particles for Heat-Free Soldering", Sci. Rep., 6: 21864, (2016), 12 pages.

(Continued)

*Primary Examiner* — Rebecca Janssen
(74) *Attorney, Agent, or Firm* — Schwegman Lundberg & Woessner, P.A.

(57) ABSTRACT

Textured particles and methods of making the same. A textured particle includes an inner core and a spherical solid outer shell including an outer surface. The inner core is inside the outer shell. The outer surface includes a first tier texture including a first metal, wherein the first metal is greater than 50 atomic % of a total atomic content of all metals in the first tier texture; a second tier texture including the second metal, wherein the second metal is greater than 50 atomic % of a total atomic content of all metals in the second tier texture; and a third tier texture including the third metal, wherein the third metal is greater than 50 atomic % of a total atomic content of all metals in the third tier texture. The first metal, second metal, and third metals are different metals.

20 Claims, 11 Drawing Sheets
(7 of 11 Drawing Sheet(s) Filed in Color)

(56) References Cited

U.S. PATENT DOCUMENTS

| | | | | |
|---|---|---|---|---|
| 2022/0212250 | A1 | 7/2022 | Thuo et al. | |
| 2022/0298401 | A1* | 9/2022 | Nomura | B22F 1/09 |
| 2023/0012401 | A1 | 1/2023 | Thuo et al. | |
| 2023/0182236 | A1 | 6/2023 | Thuo et al. | |

OTHER PUBLICATIONS

Cutinho, Joel, et al., "Autonomous Thermal-Oxidative Composition Inversion and Texture Tuning of Liquid Metal Surfaces", ACS Nano, 12, (2018), 4744-4753.

Kiarie, Winnie, et al., "Tuning Surface Texture and Composition Inversion of Galinstan by Thermal Treatment", Poster, Iowa State University, (Aug. 3, 2018), 1 pgs.

Martin, Andrew, et al., "Chameleon Metals: Autonomous Nano-Texturing and Compositoin Inversion on Liquid Metals Surface", Research Article, Wiley-VCH, Angewandte Chemie International Edition 10.1002/anie.201912639, (2019), 8.

Tevis, Ian D., "Synthesis of Liquid Core-Shell Particles and Solid Patchy Multicomponent Particles by Shearing Liquids Into Complex Particles (SLICE)", Langmuir, 30, (2014), 14308-14313.

* cited by examiner

TEXTURED PARTICLES

CROSS-REFERENCE TO RELATED APPLICATION

This application claims the benefit of priority to U.S. Provisional Patent Application Ser. No. 63/115,951 filed Nov. 19, 2020, the disclosure of which is incorporated herein in its entirety by reference.

BACKGROUND

Micro- or nano-textures can be used to control or obtain specific properties useful for a wide variety of purposes. However, such textures can be difficult and time-consuming to generate, and many existing methods for forming such textures suffer from inability to control or modify the type of texture formed.

SUMMARY OF THE INVENTION

Various embodiments provide a textured particle including an inner core and a spherical solid outer shell including an outer surface, wherein the inner core is inside the outer shell. The outer surface includes a first tier texture including a first metal, wherein the first metal is greater than 50 atomic % of a total atomic content of all metals in the first tier texture. The outer surface includes a second tier texture including the second metal, wherein the second metal is greater than 50 atomic % of a total atomic content of all metals in the second tier texture. The outer surface also includes a third tier texture including the third metal, wherein the third metal is greater than 50 atomic % of a total atomic content of all metals in the third tier texture. The first metal, second metal, and third metals are different metals.

Various embodiments provide a catalyst, tribological device, optical device, or surface coating including the textured particles.

Various embodiments provide a method of using the textured particle. The method includes using the textured particle as a component of a catalyst, a tribological device, an optical device, a surface coating, or a combination thereof.

Various embodiments provide a method of using the textured particle. The method includes using the textured particle as a catalyst, to inhibit corrosion, to tune surface properties, to tune optical properties, controlling wetting of a surface, or a combination thereof.

Various embodiments provide a method of forming the textured particle. The method includes heat treating a starting material particle. The starting material particle includes an inner core including the first metal, the second metal, and the third metal. The starting material particle also includes a solid outer shell including an oxide of the first metal.

BRIEF DESCRIPTION OF THE FIGURES

The patent or application file contains at least one drawing executed in color. Copies of this patent or patent application publication with color drawing(s) will be provided by the Office upon request and payment of the necessary fee.

The drawings illustrate generally, by way of example, but not by way of limitation, various embodiments of the present invention.

DETAILED DESCRIPTION OF THE INVENTION

Figure 1:
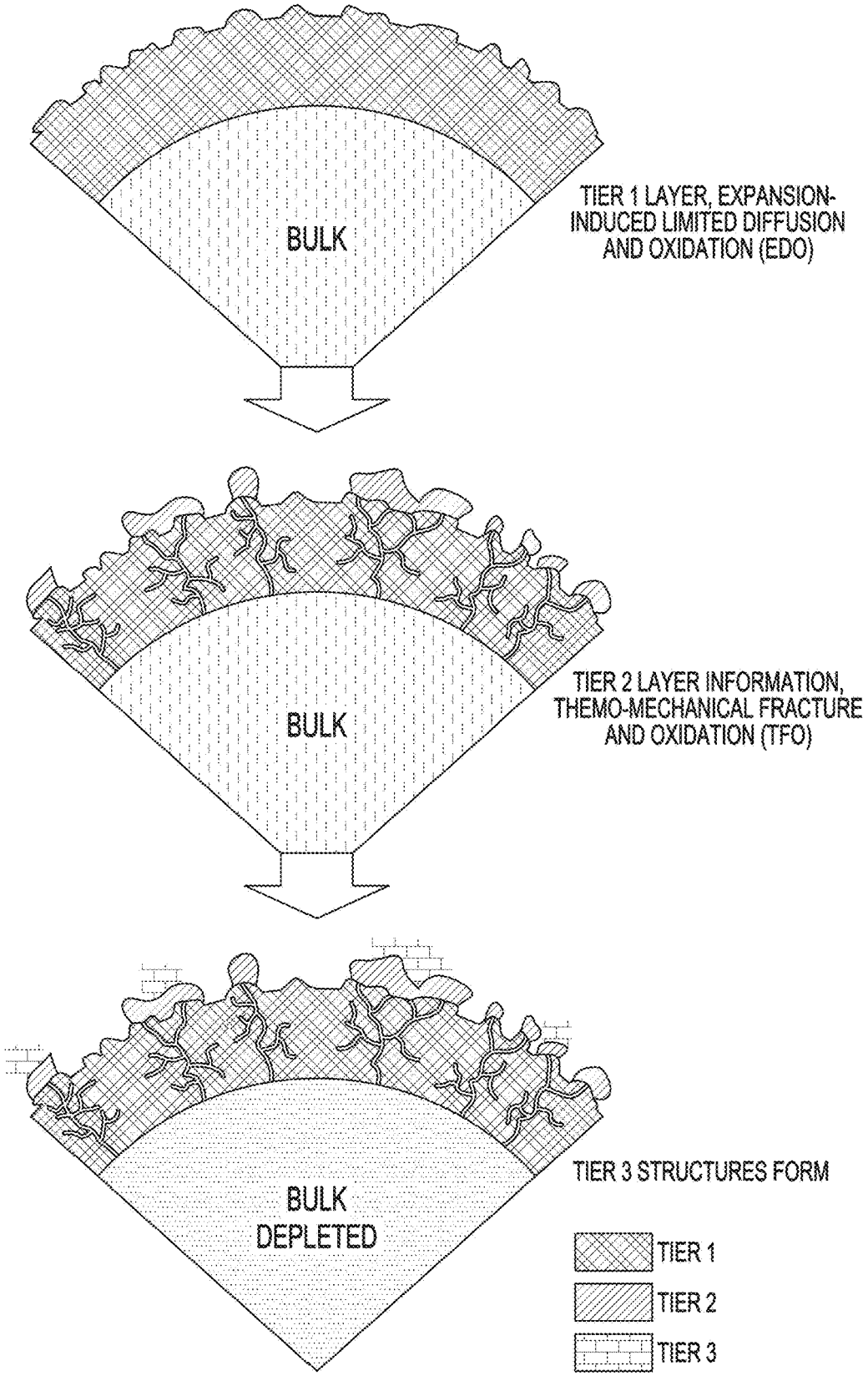
FIG. 1 illustrates fractal based crack formation and propagation, in accordance with various embodiments.

Reference will now be made in detail to certain embodiments of the disclosed subject matter. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that about 0 wt % to about 5 wt % of the composition is the material, or about 0 wt % to about 1 wt %, or about 5 wt % or less, or less than, equal to, or greater than about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less, or about 0 wt %.

The term "hydrocarbon" or "hydrocarbyl" as used herein refers to a molecule or functional group that includes carbon and hydrogen atoms. The term can also refer to a molecule or functional group that normally includes both carbon and hydrogen atoms but wherein all the hydrogen atoms are substituted with other functional groups.

As used herein, the term "hydrocarbyl" refers to a functional group derived from a straight chain, branched, or cyclic hydrocarbon, and can be alkyl, alkenyl, alkynyl, aryl, cycloalkyl, acyl, or any combination thereof. Hydrocarbyl groups can be shown as $(C_a\text{-}C_b)$hydrocarbyl, wherein a and b are integers and mean having any of a to b number of carbon atoms. For example, $(C_1\text{-}C_4)$hydrocarbyl means the hydrocarbyl group can be methyl($C_1$), ethyl ($C_2$), propyl ($C_3$), or butyl($C_4$), and $(C_0\text{-}C_b)$hydrocarbyl means in certain embodiments there is no hydrocarbyl group.

As used herein, the term "polymer" refers to a molecule having at least one repeating unit and can include copolymers.

Textured Particle.

Various embodiments provide a textured particle. The textured particle includes an inner core. The textured particle includes a spherical solid outer shell including an outer surface. The inner core is inside the outer shell. The outer shell includes a first tier texture including a first metal, wherein the first metal is greater than 50 atomic % of a total atomic content of all metals in the first tier texture. The outer shell also includes a second tier texture including the second metal, wherein the second metal is greater than 50 atomic % of a total atomic content of all metals in the second tier texture. The outer shell also includes a third tier texture including the third metal, wherein the third metal is greater than 50 atomic % of a total atomic content of all metals in the third tier texture. The first metal, second metal, and third metals are different metals.

The first metal is greater than 50 atomic % of a total atomic content of all metals in the first tier texture, such as greater than 55 atomic %, 60, 65, 70, 75, 80, 85, 90, or greater than 95 atomic % of all metals in the first tier texture.

The second metal is greater than 50 atomic % of a total atomic content of all metals in the second tier texture, such as greater than 55 atomic %, 60, 65, 70, 75, 80, 85, 90, or greater than 95 atomic % of all metals in the second tier texture.

The third metal is greater than 50 atomic % of a total atomic content of all metals in the third tier texture, such as greater than 55 atomic %, 60, 65, 70, 75, 80, 85, 90, or greater than 95 atomic % of all metals in the third tier texture.

The first tier texture, second tier texture, third tier texture, or a combination thereof, can include or be formed of any suitable shape, such as including spheres, nanowires, irregular shapes, a fractal pattern, or a combination thereof.

The textured particle can be free of tier textures other than the first tier texture, second tier texture, and the third tier texture. The textured particle can be free of metals other than the first metal, the second metal, and the third metal. In other embodiments, the textured particle can include additional tier textures and/or metals. For example, the outer surface can further include a fourth tier texture including a fourth metal. The fourth metal can be different than the first metal, second metal, and the third metal. The fourth metal can be greater than 50 atomic % of a total atomic content of all metals in the fourth tier texture, such as greater than 55 atomic %, 60, 65, 70, 75, 80, 85, 90, or greater than 95 atomic % of all metals in the fourth tier texture. The outer surface can further include a fifth tier texture including a fifth metal. The fifth metal can be different than the first metal, second metal, the third metal, and the fourth metal. The fifth metal can be greater than 50 atomic % of a total atomic content of all metals in the fifth tier texture, such as greater than 55 atomic %, 60, 65, 70, 75, 80, 85, 90, or greater than 95 atomic % of all metals in the fourth tier texture. The textured particle can optionally include tier textures that are greater than 5, such as 6, 7, 8, 9, or 10 or more tier textures.

The core can be any suitable core. The core can be hollow (e.g., include one or more hollow spaces or voids within a material that is adhered to or contacting the inner side of the outer shell), or the core can be substantially free of hollow areas or voids. The core can include a metal composition, such as a metal composition that complete fills the core or a metal composition that has one or more hollow areas or voids therein. The metal composition in the core can include a liquid phase, a solid phase, or a combination thereof. In some embodiments, the metal composition in the core is free of liquid phases. In some embodiments, the metal composition in the core is free of solid phases.

The metal composition in the core can include the third metal. The third metal can be greater than 50 atomic % of a total atomic content of the first metal, the second metal, and the third metal in the metal composition, such as greater than 55 atomic %, 60, 65, 70, 75, 80, 85, 90, or greater than 95 atomic % of all metals in the metal composition. The metal composition in the core can have the same or similar composition as the composition of the third tier texture.

The outer shell of the texture particle can include the first metal. The first metal can be greater than 50 atomic % of a total atomic content of the first metal, the second metal, and the third metal in the outer shell, such as greater than 55 atomic %, 60, 65, 70, 75, 80, 85, 90, or greater than 95 atomic % of all metals in the outer core. The first metal in the outer shell can be in the form of an oxide of the first metal. The outer shell can have the same or similar composition as the first tier texture. In the formation of the textured particle, the first tier texture can form on the shell. Compared to the outer shell, the first tier texture can have a different texture than the outer shell, a different distribution (e.g., the shell can be relatively homogeneously distributed about the core, whereas the first tier texture can have a heterogeneous distribution about the outer shell), and a different distance from the center of the particle (e.g., the outer shell is closer to the center than the first tier texture.

The first metal, the second metal, and the third metals in the first tier texture, second tier texture, and the third tier texture can be in any suitable form. For example, the first metal, the second metal, and the third metals in the first tier texture, second tier texture, and the third tier texture can be in the form of an oxide of the first metal, an oxide of the second metal, and an oxide of the third metal. The first metal, the second metal, and the third metals in the first tier texture, second tier texture, and the third tier texture can be in the form of nitrides, nitrates, nitrites, organometallics (e.g., a carboxylate, an amidate, or a combination thereof), or a combination thereof, of the first metal, second metal, or the third metal.

The outer shell excluding the first, second, and third tier textures can have a diameter of 0.01 microns to 50 microns, or 0.02 microns to 10 microns, or 1 micron to 5 microns, or less than or equal to 50 microns and greater than or equal to 0.01 microns, 0.02, 0.05, 0.1, 0.2, 0.3, 0.4, 0.5, 0.6, 0.7, 0.8, 0.9, 1, 1.5, 2, 2.5, 3, 3.5, 4, 4.5, 5, 6, 7, 8, 9, 10, 12, 14, 16, 18, 20, 25, 30, 35, 40, or 45 microns.

The combination of the first, second, and third tier textures (and any other optional one or more tier textures such as fourth or fifth tier textures) can extend away from the outer core any suitable amount, such as by a distance that is 0.1% to 300% of a diameter of the outer shell excluding the first, second, and third tier textures, or 0.5% to 50%, or 1% to 30%, or less than or equal to 300% and greater than or equal to 0.1%, 0.5, 1, 2, 3, 4, 5, 6, 8, 10, 12, 14, 16, 18, 20, 25, 30, 35, 40, 45, 50, 60, 70, 80, 90, 100, 125, 150, 175, 200, 250, or 2%. The combination of the first, second, and third tier textures (and any other optional one or more tier textures such as fourth or fifth tier textures) can extend away from the outer core any suitable distance, such as a distance of 0.1 microns to 50 microns, or 0.1 microns to 5 microns, or less than or equal to 50 microns and greater than or equal to 0.1 microns, 0.2, 0.4, 0.6, 0.8, 1, 1.2, 1.4, 1.6, 1.8, 2, 2.2, 2.4, 2.6, 2.8, 3, 3.2, 3.4, 3.6, 3.8, 4, 4.2, 4.4, 4.6, 4.8, 5, 6, 7, 8, 9, 10, 15, 20, 25, 30, 35, 40, or 45 microns.

The first tier texture, second tier texture, and third tier texture can have any suitable spatial relationship with respect to each other and with respect to the outer core, as consistent with the formation mechanism described herein for the textured particle. For example, the first tier texture can directly contact the outer shell. The second tier texture can directly contact the outer shell, the first tier texture, or a combination thereof. The second tier texture can directly contact the first tier texture. The third tier texture can directly contact the outer shell, the first tier texture, the second tier texture, or a combination thereof. The third tier texture can directly contact the first tier texture, the second tier texture, or a combination thereof. The third tier texture can be free of direct contact with the outer shell. The third tier texture can directly contact the second tier texture. The third tier texture can be free of direct contact with the first tier texture.

The first metal, the second metal, and the third metal can be any suitable combination of three different metals that can be used to form the textured particle described herein. The first metal, the second metal, and the third metal can each have different thermal expansivities. The first metal, the second metal, and the third metal can be independently chosen from Al, Fe, Cu, Zn, Ga, Ge, Ag, Cd, In, Sn, Sb, Te, Ho, Au, Pb, and Bi. The first metal, the second metal, and the third metal can be independently chosen from Ga, In, Sn, Bi, Al, Pb. In some embodiments, the first metal is Ga, the second metal is In, and the third metal is Sn. In some embodiments, the first metal is Sn, the second metal is In, and the third metal is Ga. In some embodiments, the first metal is In, the second metal is Sn, and the third metal is Bi (e.g., textured particle is derived from Field's metal). In some embodiments, the first metal is Bi, the second metal is Sn, and the third metal is In (e.g., textured particle is derived from Field's metal).

Article, Device, Composition, or Material Including the Textured Particles.

Various embodiments provide an article, device, composition, or material including the textured particles. For example, various embodiments provide catalyst, tribological device, optical device (e.g., including a wave guide, a plasmonic component, or a combination thereof), surface coating (e.g., corrosion-inhibiting coating and/or coating having other functionality), or a combination thereof, that includes the textured particles.

Method of Using the Textured Particle.

Various embodiments provide a method of using the textured particles. For example, various embodiment provide a method of using the textured particles as a component of an article, device, composition, or material. The method can include using the textured particle as a component of a catalyst, a tribological device, an optical device, a surface coating, or a combination thereof. The method can include using the textured particle as a catalyst, to inhibit corrosion, to tune surface properties, to tune optical properties, to control wetting of a surface, or a combination thereof.

Method of Forming the Textured Particle.

Various embodiments provide a method of forming the textured particle. The method can include heat treating a starting material particle. The starting material particle is a core/shell particle including an inner core that includes the first metal, the second metal, and the third metal. The starting material particle includes a solid outer shell that includes an oxide of the first metal.

The first metal, the second metal, and the third metal in the core can be a liquid in the core. The liquid can be at a temperature that is below its melting point. The liquid can be a metastable liquid.

The method of forming the textured particle can include forming the starting material particle.

The solid outer shell of the starting material particle can include ($C_1$-$C_{10}$) carboxylate ligands, such as acetate ligands. The ligands can stabilize the outer shell.

The heat treating can include heat treating in an oxidative (i.e., oxidizing) environment (e.g., in the presence of oxygen). The heat treating can include heat treating in a non-oxidizing and/or reducing environment.

The heat treating can include heating the starting material particle to a target temperature, such as any suitable target temperature that causes formation of the textured particle, such as a target temperature of 500 K to 2000 K, or 750 K to 1500 K, or 1000 K to 1300 K, or less than or equal to 2000

K and greater than or equal to 500 K, 550, 600, 650, 700, 750, 800, 850, 900, 950, 1000, 1050, 1100, 1150, 1200, 1250, 1300, 1350, 1400, 1450, 1500, 1600, 1700, 1800, or 1900 K. The heat treating can include maintaining the starting material particle at the target temperature for any suitable time that provides formation of the textured particle, such as a time of 0.1 min to 1 day, or 1 min to 2 h, or less than or equal to 1 day and greater than or equal to 0.1 min, 0.2, 0.4, 0.6, 0.8, 1, 1.5, 2, 3, 4, 5, 6, 8, 10, 12, 14, 16, 18, 20, 25, 30, 35, 40, 45, 50, 55 min, 1 h, 1.5, 2, 3, 4, 5, 6, 8, 10, 12, 14, 16, 18, 20, or 22 h.

The heat treating can include heat treating at the target temperature in an oxidative environment comprising an oxidant (e.g., oxygen), wherein the method includes controlling the target temperature and a partial pressure of the oxidant (e.g., partial pressure of oxygen) to tune a surface texture of the textured particle (e.g., to control the resulting generated surface texture of the textured particle). Controlling the target temperature and a partial pressure of the oxidant to tune a surface texture of the textured particle can include controlling a balance between the target temperature and the partial pressure of the oxidant to tune the surface texture of the textured particle. In some embodiments, heat treating in an oxidative environment can cause the third tier to be dominated by a metal (third metal) having the lowest $E_0$, the first tier to be dominated by a metal (first metal) having the highest $E_0$, and the second tier is dominated by a metal (second metal) having an intermediate $E_0$ between the $E_0$ of the first and third metals.

The heat treating can include heat treating at the target temperature in a reducing environment including a reducing agent, wherein the method includes controlling the target temperature and a concentration of the reducing agent to tune a surface texture of the textured particle. Controlling the target temperature and the concentration of the reducing agent to tune a surface texture of the textured particle can include controlling a balance between the target temperature and the concentration of the reducing agent to tune the surface texture of the textured particle. In some embodiments, heat treating in an reducing environment can cause the third tier to be dominated by a metal (third metal) having the highest $E_0$, the first tier to be dominated by a metal (first metal) having the lowest $E_0$, and the second tier is dominated by a metal (second metal) having an intermediate $E_0$ between the $E_0$ of the first and third metals.

FIG. 1 illustrates fractal-based crack formation and propagation. Tier 1 layer includes expansion-induced limited diffusion and oxidation. Tier 2 layer formation includes thermo-mechanical fracture and oxidation (TFO). Tier 2 layer formation includes initial crack propagation due to growth and thickening of the oxide layer. At a critical thickness, the oxide becomes brittle and loses plasticity allowing for the underlying layer to pass through and oxidize through a fractal channel. During formation of Tier 3 structures, the Tier 3 structures form on the outermost layer following the same channels that, were formed in the initial TFO process. Due to the lack of internal energy and pressure as well as volume, the remainder component within the system does not have enough force to create new crack propagation, such that no Tier 3 structures are formed in a new region where Tier 2 layer did not exist.

Figure 2:
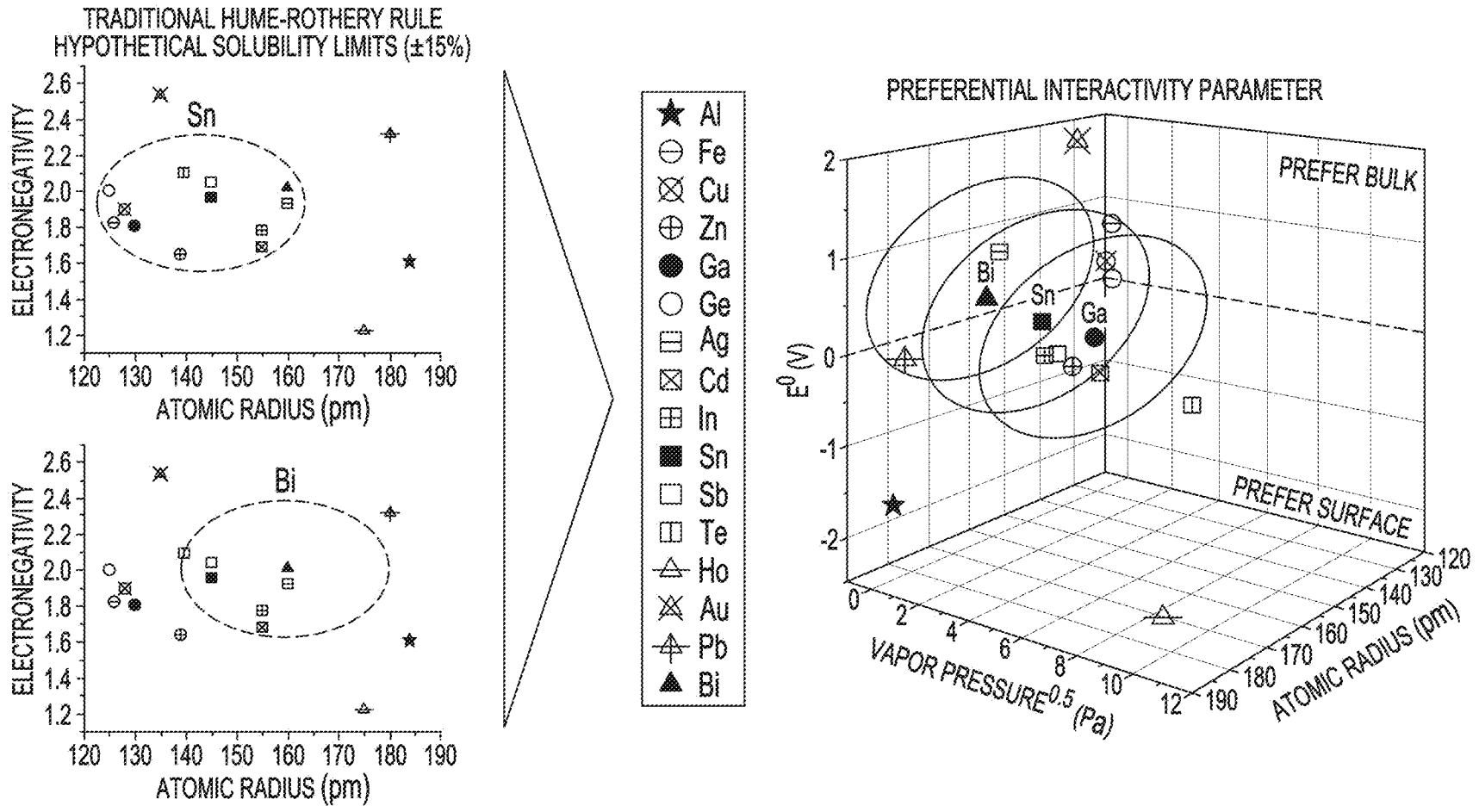
FIG. 2 illustrates design parameters and preferential interactivity parameter via 2D plots of electronegativity versus atomic radius and a 3D plot of electronegativity versus vapor pressure versus atomic radius for various types of atomic species, in accordance with various embodiments.

FIG. 2 illustrates design parameters and preferential interactivity parameter via 2D plots of electronegativity versus atomic radius and a 3D plot of electronegativity versus vapor pressure versus atomic radius for various types of atomic species. The 3D preferential interactivity parameter can be utilized to determine the preferential behavior of the metals and/or alloys thereof used within the system. The 0 $E^0$ line is considered neutral whereas a more positive value would drive an element to prefer bulk more than the surface, and vice versa.

Examples

Various embodiments of the present invention can be better understood by reference to the following Examples which are offered by way of illustration. The present invention is not limited to the Examples given herein.

Particle synthesis (Galinstan example): 100 mL of 5% (V/V) aqueous solution of glacial acetic acid was placed in Cuisinart® (SBC-1000FR) soup maker. 4 g of Galinstan (68 wt % Ga, 22 wt % In, and 10 wt % Sn) were placed in the solution and sheared at a speed of 13000 rpm for 20 minutes. The resulting suspension was allowed to settle for 5 minutes, decanted and the resulting sediment was diluted in ethanol (4×100 mL) after which it was stored in ethanol.

Particle heat treatment: The particles were heat treated using Thermogravimetric Analyzer (TA Instruments Q50 TGA) instrument. Undoped silicon wafers were cleaned using ethanol and then dried using a stream of ultrahigh-purity Nitrogen Gas. The particles were then drop cast on the clean silicon wafer and the solvent was allowed to evaporate in an oven at 60° C. for 1 min. The particles on the silicon wafer were then transferred to the TGA after being placed on a platinum pan. The heat treatment was carried in presence of air, air gas flow rate was set at 60 ml/min and ramp rate of 10° C./min.

Characterization: The as-synthesized particles were imaged using scanning electron microscopy (FEI-SEM Quanta 250). Prior to imaging, all heat-treated particles were equilibrated to ambient conditions and mounted on a flat SEM stub (Ted Pella, Inc.) using a copper tape. An accelerating voltage of 10 kV and working distance of ca. 10 mm was used for the imaging. Images were obtained using an Everhart-Thornley secondary electron detector. Elemental analysis was carried out using Energy Dispersive X-ray Spectrometer (EDS). Accelerating voltage of 15 kV and a working distance of 10 mm was used to attain high spectral resolution. Maps were taken at 1024 pixel resolution with 500 μs dwell time.

Focused Ion Beam (FIB) Machining and Preparation: Heat treated sample was mounted on a flat SEM stub (Ted Pella, Inc.) on which copper tape had been laid, carbon paint was added on the edges of the sample for better conductivity. Sample was prepared using a FEI Helios NanoLab G3. Eucentric height of the system was established as 4 mm and was used for milling and imaging. Machining was carried out at 16 kV on the Ion column using Si-α beam. The machining was performed at 52 degrees tilt, so that the surface was perpendicular with respect to the ion beam column axis. Imaging of cut sample was done at 3 kV using an Everhart-Thornley secondary electron detector. The sample was then rotated to face the EDS take-off tube for elemental mapping. Spectra were taken at 25 kV for all milled samples.

Discussion

Studies on passivating oxides on liquid metals are challenging, in part, due to plasticity, entropic, and technological limitations. In alloys, compositional complexity in the passivating oxide(s) and underlying metal interface exacerbates these challenges. This nanoscale complexity, however, offers an opportunity to engineer the surface of the liquid metal under felicitous choice of processing conditions. Here we present a simple thermal-oxidative compositional inversion (TOCI) method to introduce fractal-like structures on the surface of these metals in a controlled (tier, composition, and structure) manner by exploiting underlying stochastic fracturing process. Using a ternary alloy, a three-tiered (in structure and composition) surface structure is demonstrated.

A surface of a material is its dissipation horizon (both mass and energy), and hence plays a critical role in establishing equilibria between otherwise thermodynamically dissimilar (material vs air) systems. Though limited in total number of atoms, surfaces or interfaces are an ensemble of disparate energy microstates. By necessity, curved surfaces often bear sharp energy and compositional gradients (as captured by interfacial excess, $\Gamma_i$, and the Laplace pressure jump condition, $\Delta P$). These gradients, in turn, can dictate energy state(s) of the enclosed bulk. In metal systems, for example, formation of passivating oxides induces both adverse (e.g. non-Newtonian flow, lustre, surface defects, wettability, metastability) and advantageous (e.g. protection, catalysis, redox buffering, and undercooling) properties. These surface oxides can grow to their equilibrium dimensions within milliseconds and passivate depending on the conditions. Oxidation, however, depends on stoichiometry, oxidant diffusion, reduction potential ($E^0$), microstructure, cohesive energy density, atomic size, temperature and pressure. In metallic alloys, the complexity of this oxidation process necessitates a kinetics-driven differentiation and in situ self assembly across a thin (7-30 Å) interlace. Selectively engineering this thin, complex, tangential, component(s) of a material is challenging due to entropic domination by the bulk.

In liquid metal alloys, the oxide interface in which this self-limiting oxidation process occur is a complex pseudo-equilibrium system. In oxidizing environment at time, t=0, all elemental components of an alloy can oxidize. This initial stoichiometric dictated oxidation kinetically self-sorts based on $E^0$, cohesive energy density, atomic size (hence diffusivity) and oxygen partial pressure. At t>0, the lowest $E^0$ element eventually dominates the exterior surface of the metal. For a eutectic (or other stable) alloy mixture, continued oxidation may perturb the bulk equilibrium composition as one (or more) of the components is selectively removed. This compositional change, albeit small, induces an interface accumulation of higher $E^0$ component(s). Shift from statistical—(at t=0) to $E^0$—driven oxidation, coupled with diminished oxidant flux, leads to formation of sub-oxides beneath the oxidized low $E^0$ component, while the interface phase-segregated components bridge the sub-oxides to the bulk. This self-sorting process leads to a structured, layered interface with sharp composition gradients. Such sharp concentration gradients imply that the oxide-bulk metal interface has a high chemical potential gradient, ($\Delta\mu$). An exponential decay in oxide growth is expected and at a certain critical thickness ($d_c^P$) passivation occurs.

Figure 3:
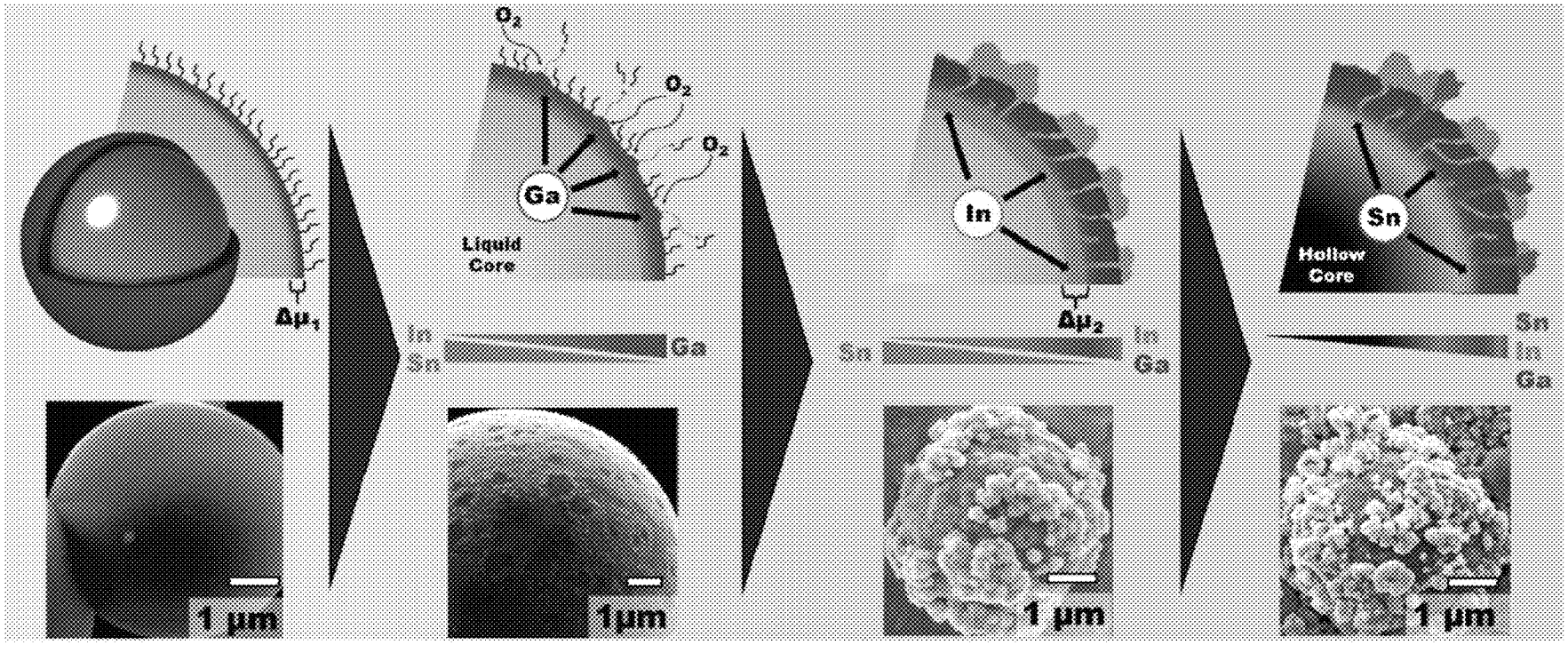
FIG. 3 illustrates schematics of oxide transformation mechanism for ternary core-shell liquid metal particle, and SEM images of different oxidation steps correlating with the mechanisms, in accordance with various embodiments.

Akin to the surface of a liquid (shift in Gibbs dividing plane), surface composition changes when these metal-oxide interfaces are thermally perturbed. Considering that oxygen flux increases with temperature, $d_c^P$ increases with concomitant increase in high temperature, amount of high $E^0$ element sub-oxides, and segregated elemental components (FIG. 3). FIG. 3 illustrates schematics of oxide transformation mechanism for a ternary core-shell liquid metal particle and SEM images of different oxidation steps correlating with the mechanisms. The stochastic increase in diffusion and volumetric change in the surface oxide implies that texturing should occur, with thermal stress leading to fracture and release of the underlying concentration-differentiated layers. The process repeats ad infinitum until the next subsequently lower $E^0$ component is significantly depleted or the particle is fully oxidized. It therefore follows that surface of a liquid metal particle can continuously invert its composition under thermal stimuli rendering them 'chameleon surfaces'. Herein we demonstrate this behavior, and its potential in surface patterning in a ternary alloy.

Eutectic gallium-indium-tin (Galinstan: 68% Ga, 22% In, 10% Sn w/w; m.p. 11° C.) core-shell particles were synthesized using the SLICE method. The synthesized particles were ca. 1-5 μm in diameter, with a liquid core and a smooth surface oxide stabilized by an acetate ligand (FIG. 3). For clarity and brevity all particle images are false colored. These particles were then thermally treated (up to 1273 K) in a Thermogravimetric analysis (TGA) instrument (here used as an oven) under reduced oxygen at 100 K increments.

Figure 4:
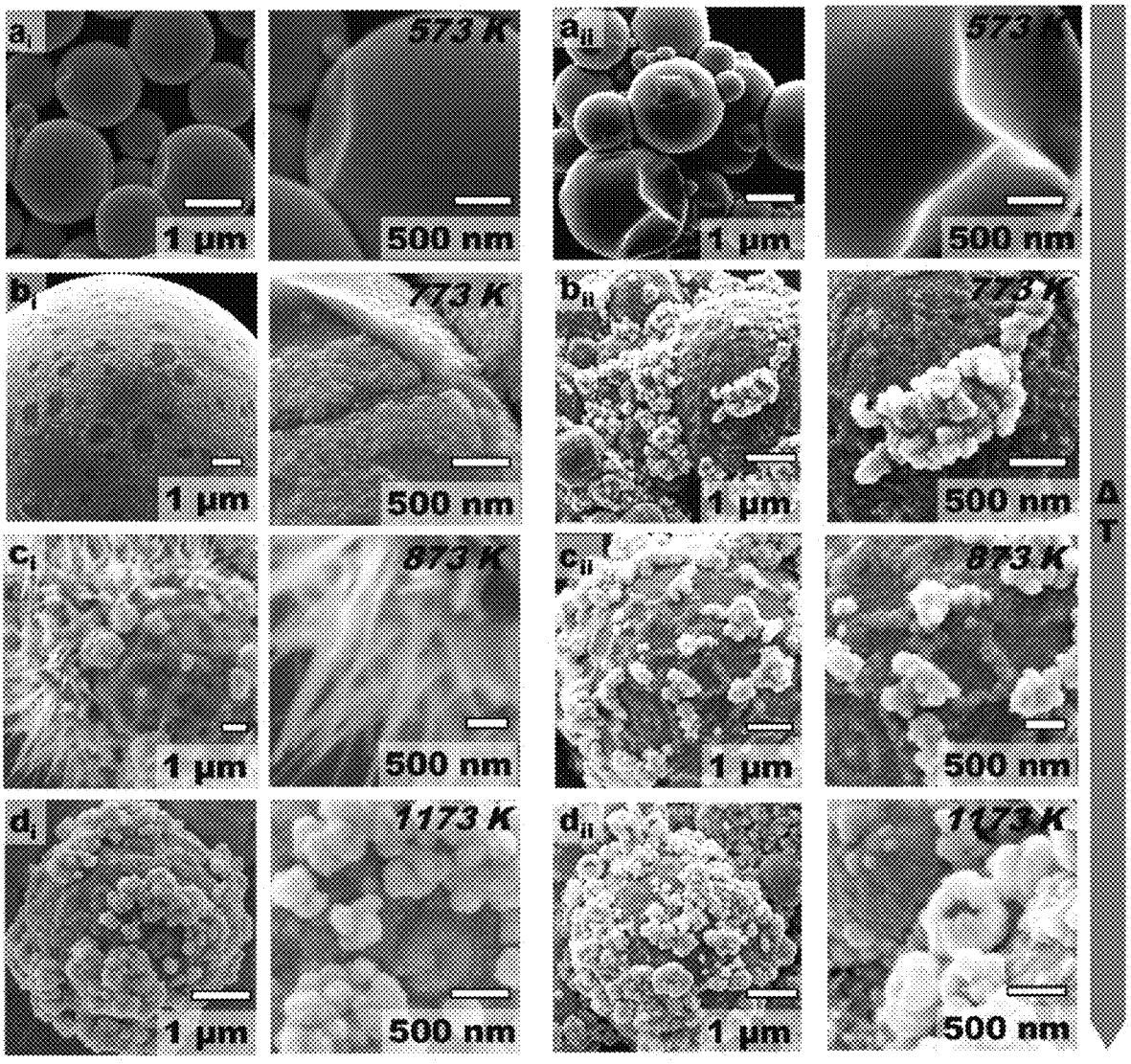
FIG. 4 illustrates micrographs of GaInSn particles heat treated for (i) 0 isothermal time, ($a_{ii}$) 30 minutes, ($b_{ii}$) 45 minutes, ($c_{ii}$) 30 minutes and ($d_{ii}$) 60 minutes isothermal time at (a) 573 K (b) 773 K (c) 873 K and (d) 1173 K, in accordance with various embodiments.

FIG. 4 illustrates micrographs of GaInSn particles heat treated for (i) 0 isothermal time, ($a_{ii}$), 30 minutes, ($b_{ii}$) 45 minutes, ($c_{ii}$) 30 minutes and ($d_{ii}$) 60 minutes isothermal time at (a) 573 K (b) 773 K (c) 873 K and (d) 1173 K. With false colouring in high-magnification images highlighting the different tiers of surface texture modification. For clarity gallium-(purple), indium-(blue), and tin-(pink) rich regions are highlighted. Surface morphology change in Galinstan particles is visible starting at 573 K ($a_i$). Shape deformations (depressions) are observed, likely due to thermal expansions and contractions. Adding isothermal time at this temperature, or raising the temperature to 673 K, increases the severity of these deformations ($a_{ii}$). Increase in temperature, however, enhances oxygen permeability enabling further oxidation (expansion-induced diffusion-limited oxidation, EDO). At 773 K surface texture changes are observed ($b_i$), as a new layer (tier I) starts forming on top of the smooth depressed passivating shell. Some variations of this surface feature exist due to potential thermal gradient and proximity to the pan walls in the TGA. Surface cracks are also observed at high curvature points ($b_i$) suggesting that the oxide shell is fairly thick hence fractures with thermal expansion-contraction. For brevity, this process is referred to as thereto-mechanical fracture leakage and oxidation (TFO). As expected, holding the particle at 773 K leads to continued growth of tier I to almost complete surface coverage ($b_{ii}$). Holding the sample at this temperature (isothermal time) also allow the oxide to thicken to a point where it can withstand thermal shock and surface depressions are no longer observed ($b_{ii}$). Concomitant generation of a new, compositionally different, layer (tier II) occurs on adding isothermal time. This new layer is stochastically distributed throughout the surface of the particles, albeit at low surface coverage ($b_{ii}$). Increasing the treatment temperature to 873 K leads to rapid growth of the tier II material resulting in surface-grafted nanowires ($c_i$). Adding isothermal time or increasing the temperature to 973 K leads to a significant decrease in the surface nanowire population and conversion to sintered particle networks ($c_{ii}$). We infer this evolution to be due to sintering of the nanowires, with increased oxidation rate, confirming that the nanowires are a kinetic product—e.g., growth rate needs to be higher than the agglomeration/sintering rate.

At 1173K, onto the tier I covered surface, more tier II forms ($d_i$). We observe that the texture of tier I is significantly different than that observed at 773 K, with a central depression surrounded by an annular structure ($d_i$). The grainy structure of these features suggests that they are likely formed from an Ostwald-type ripening of small particles that upon cooling—and associated surface changes, contract into these annular structures. A similar grainy structure and sintering of spherical units is also observed for tier II but without the annular structure ($d_i$). When the particles are held at 1173 K for ≥30 minutes, new compositionally different features are observed (tier III), These new features have a central crater surrounded by petal-like structures ($d_{ii}$). Tier III grows on top of either tier I or II, although significant localization around tier II is observed. This selective distribution leads us to infer that tier II may be associated with the generation of the compositionally different layers from which tier III emanates. This inference is in line with TFO and the ansatz that selective ($E^o$-driven) oxidation of an alloy surface leads interfacial enrichment of the lesser reactive component. This enrichment should manifest in the compositional of the resulting oxides when selectively released. To confirm this observation, in a 3-component alloy, further oxidation after formation of tier III should lead to complete solidification of the particle as no other element can be released.

Figure 5A:
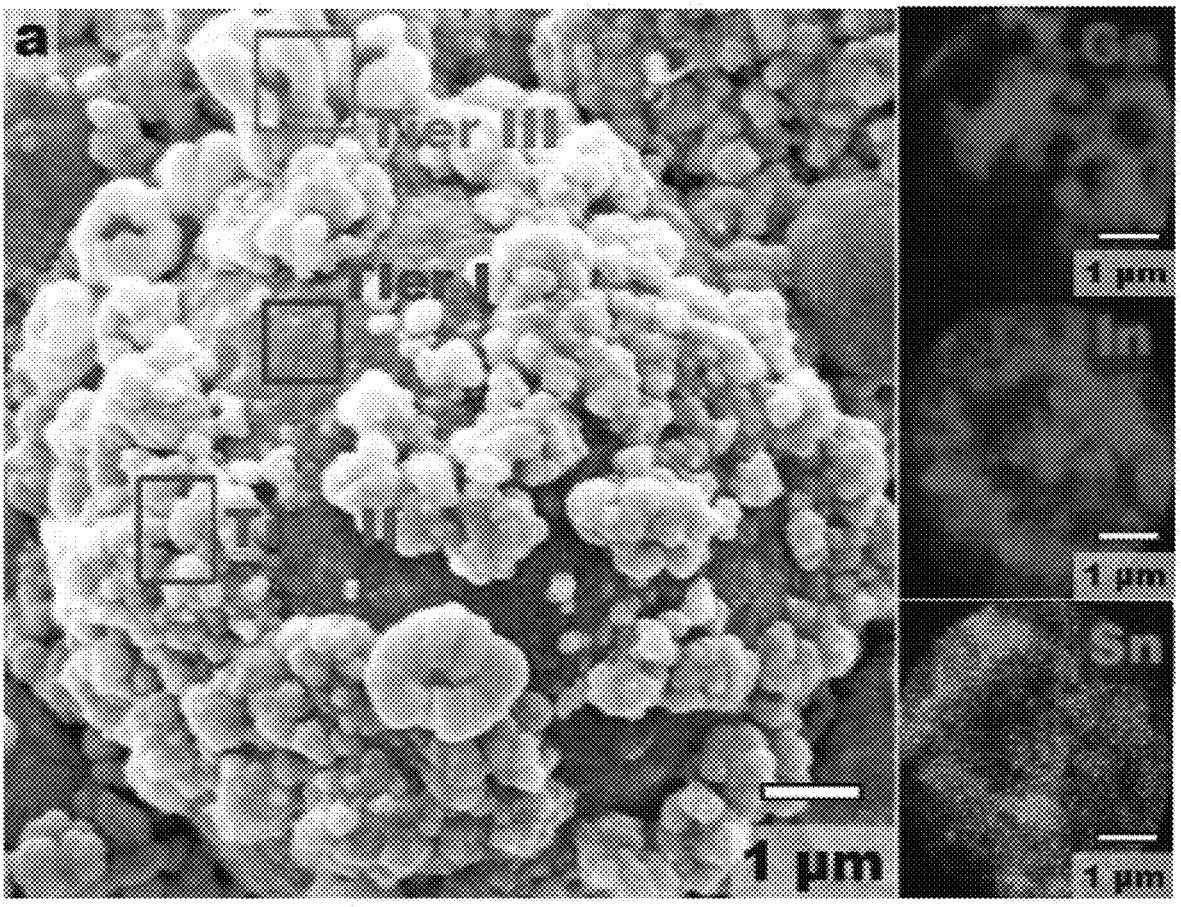
FIG. 5*a* illustrates an EDS Map of GaInSn particle heat treated for 60 minutes at 1173 K, in accordance with various embodiments.
Figure 5B:
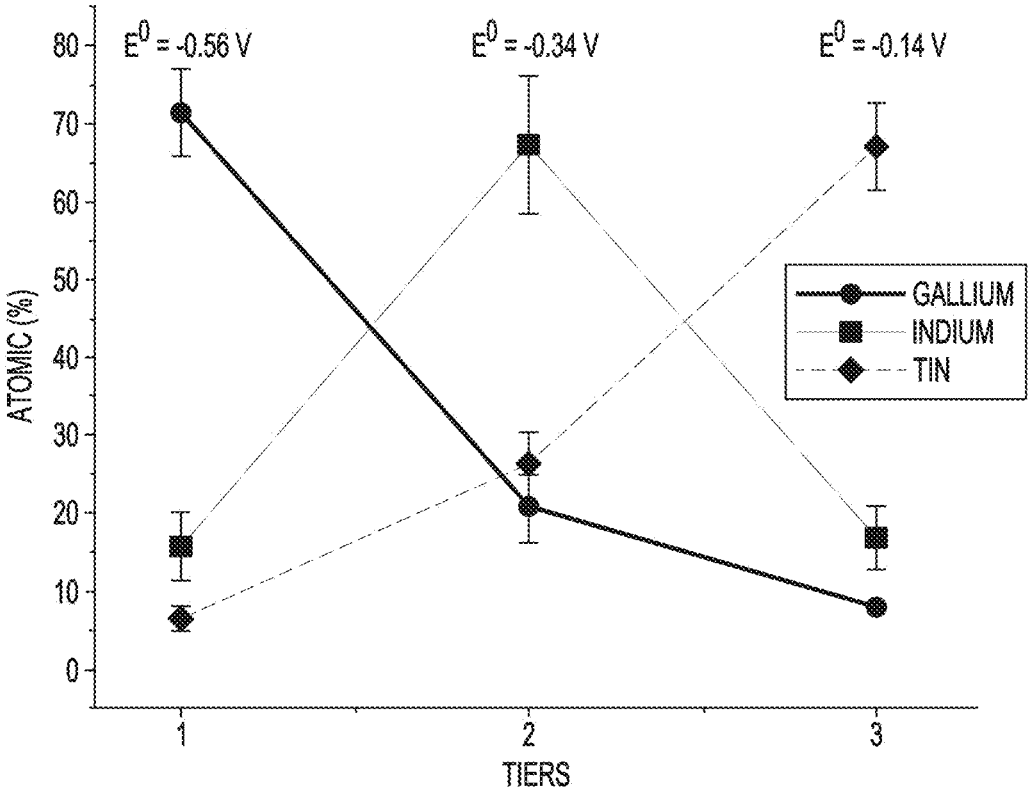
FIG. 5*b* illustrates a concentration average of heat-treated particle shown in FIG. 5*a*, separated in 3 different tiers, in accordance with various embodiments.
Figure 5C:
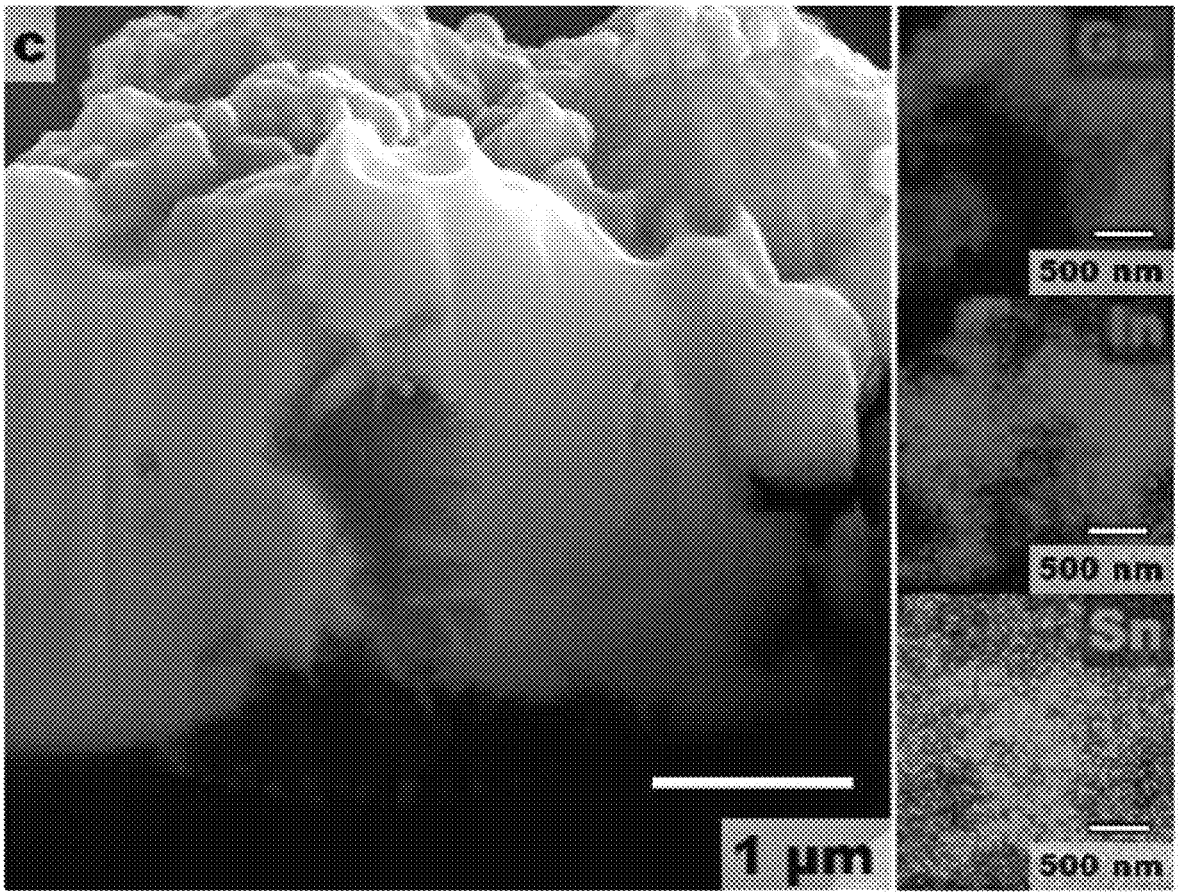
FIG. 5*c* illustrates a cross-sectional EDS Map of particle treated at 1173 K, in accordance with various embodiments.
Figure 5D:
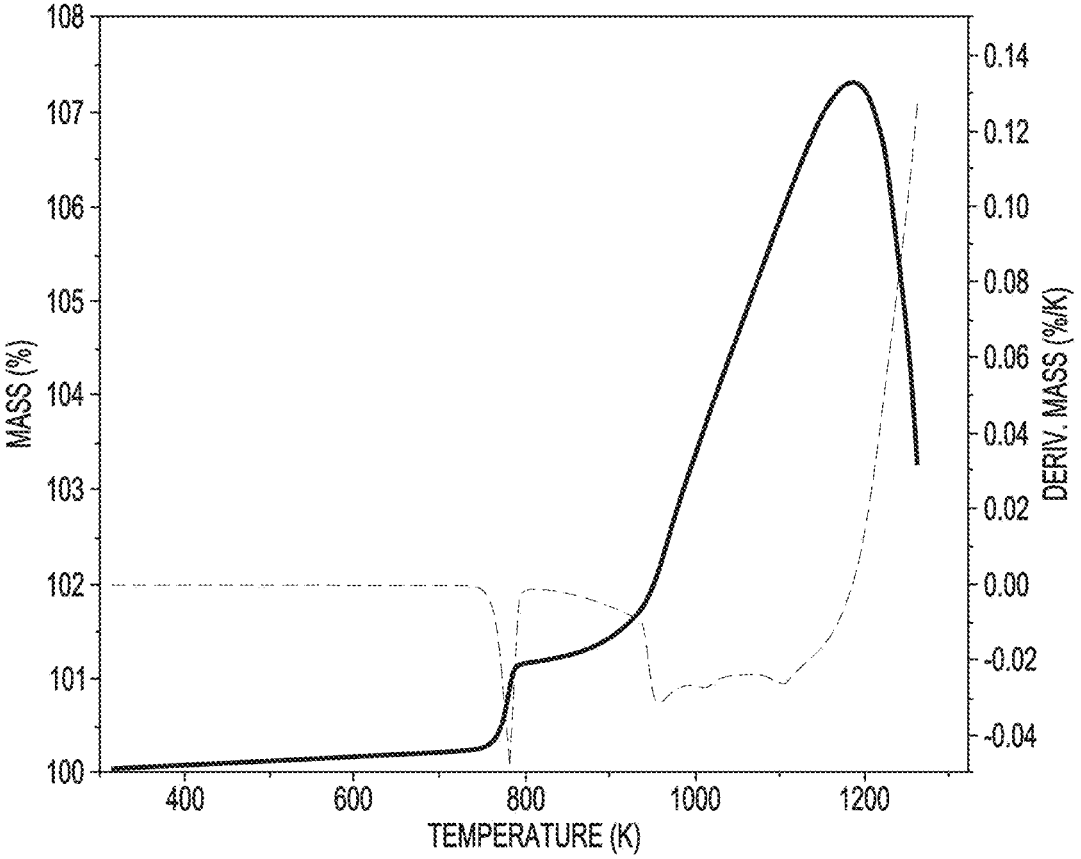
FIG. 5*d* illustrates a TGA curve of heat-treated Galinstan particles, in accordance with various embodiments.
Figure 5E:
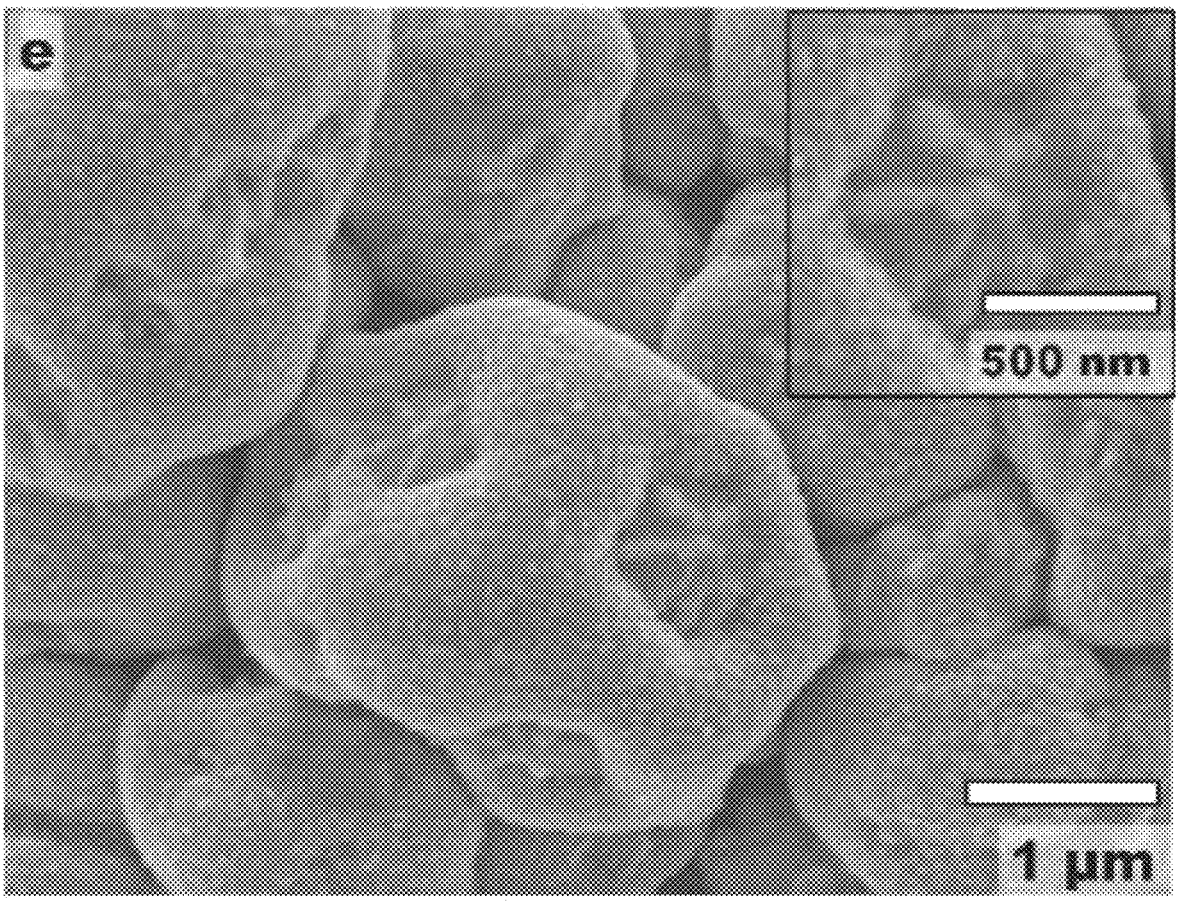
FIG. 5*e* illustrates a SEM Micrograph of a particle heated to 1273 K, in accordance with various embodiments.

Energy Dispersive X-ray Spectroscopy (EDS) analysis of the surface of the three-tiered particle, and its cross-section, revealed the hypothesized compositional asymmetry in the tiers and across the structure of the fully oxidized particle (FIGS. 5*a-e*). FIG. 5*a* illustrates an EDS Map of GaInSn particle heat treated for 60 minutes at 1173 K. FIG. 5*b* illustrates a concentration average of heat-treated particle shown in FIG. 5*a*, separated in 3 different tiers. FIG. 5*c* illustrates a cross-sectional EDS Map of particle treated at 1173 K. FIG. 5*d* illustrates a TGA curve of heat-treated Galinstan particles. FIG. 5*e* illustrates a SEM Micrograph of a particle heated to 1273 K. A compositional map of a full particle shows complimentary distribution in the three components making up the alloy (FIG. 5*a*). Tier I is gallium-rich, tier II is largely indium, while tier III is enriched in tin (FIG. 5*b*). Each major element makes up ~70% of the metals in their respective tier. We observe that the non-major components are ~5-20 atomic %. The lowest $E^0$ component, Ga, decreases with increase in tier level while highest $E^0$, Sn, has an inverse progression (FIG. 5*b*). Indium, with an $E^0$ between Ga and Sn, has a maxima at tier II(FIG. 5*b*). The correlation between tier level and progression in $E^0$ suggests that the tier are associated with interfacial phase segregation, hence TFO. Previously, analogous EDS analysis was compared to surface-sensitive Auger and XPS (x-ray photoelectron) spectroscopy with good agreement. We, therefore, similarly infer that the EDS data is representative of surface differences. To further support the ansatz on gradients in interface composition, we analyzed distribution of the three components across the diameter of a particle that had been heated at 1173 K for 60 minutes (fully oxidized). We anticipated, and confirmed, that this treatment would lead to complete oxidation of the particle, hence solidification, allowing us to section it using FIB (focused ion beam), FIG. 5*c* shows a cross-section of such a particle with the associated EDS-based elemental maps. The core of the particle is Sn-rich, even though Sn is only 10% of the starting alloy. Progression in composition mirrors that of decreasing surface tier levels, that is; the core is Sn rich while the surface is Ga-rich with In enriching an intermediate section. We therefore infer that the surface texturing is a Thermal-Oxidative Compositional Inversion (TOCI) process that is governed by the reduction potential, and concomitant interfacial enrichment immediately below the passivating oxide shell.

To further confirm the sequential nature of this oxidation driven surface composition inversion, we analyzed mass changes with increase in temperature (FIG. 5*d*). Based on previous studies, we anticipate that, the acetate ligand will desorb before the formation of tier 1. An initial slow, but gradual increase in mass is observed on the thermogram. A sharp increase in mass is observed at 773 K which coincides with appearance of tier II. A second mass increase is observed from 993 K (tier III) but this drops at ca. 1.273 K. A gradual loss in mass is observed beyond this temperature which confirms that all possible oxidation is achieved and either volatilization of the lowest vapor pressure component is occurring or this could be due to degradation of the oxide. As a control, we repeat this measurement under inert atmosphere and observe no significant change in mass indicating that the gain is due to oxidation. We observe that the particle morphology changes with some of the more prominent features varnishing and the particles volumetrically shrink suggesting mass loss (FIG. 5*e*). Based on the stepwise TFO surface texture evolution, we hypothesized that exploitation of surface fracture patterns of the thickening oxide can lead to controlled growth of fractal-like patterns on the surface of the particles.

Fractal-like growth of metal oxide surface structure has been demonstrated via deposition. Autonomous compositional tunable growth of such oxides has, however, not been reported. From the discussion above, we infer that such patterning can be accomplished using TOO albeit under felicitous choice of reaction conditions. Since our approach is based on fracture patterns across the passivating oxide layer, we anticipate that the patterns will highly depend on alloy composition and oxide thickness. Since Galinstan forms a predominantly gallium oxide shell, we demonstrate this fractal-like patterning using Ga-based alloys. A focus on Ga limits this investigation to tier I only.

Figure 6A:
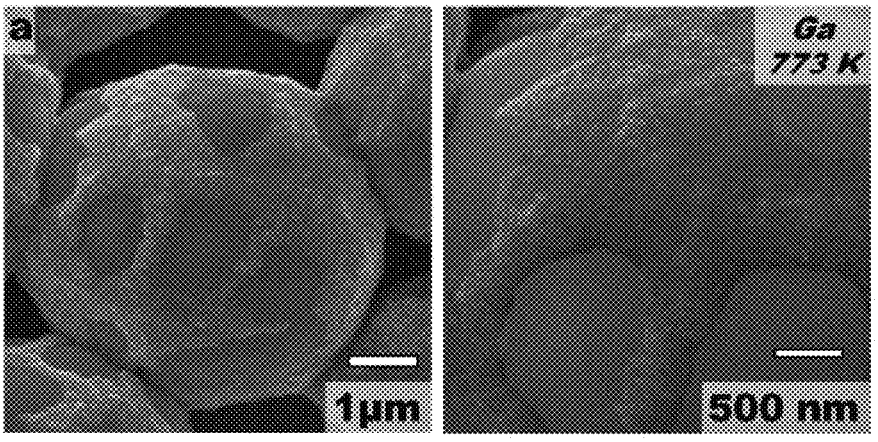
FIG. 6*a* illustrates a micrograph of unary gallium treated at 773 K (t=0), in accordance with various embodiments.
Figure 6B:
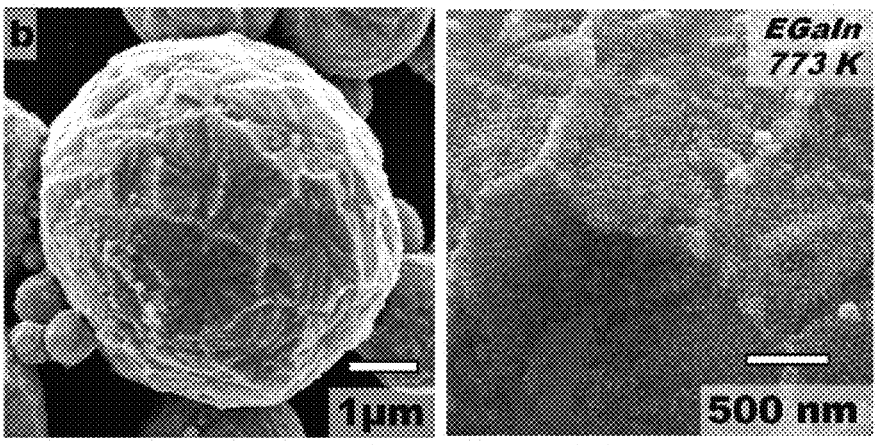
FIG. 6*b* illustrates a micrograph of EGaIn treated at 773 K (t=0), in accordance with various embodiments.
Figure 6C:
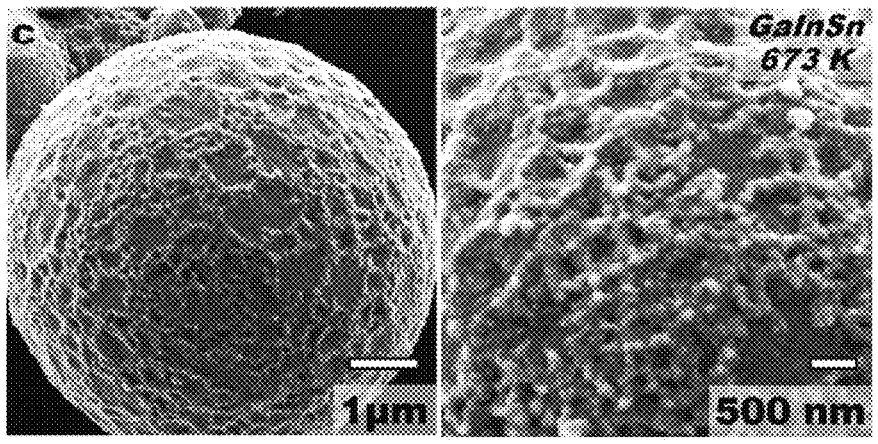
FIG. 6*c* illustrates a micrograph of Galinstan treated at 673 K (t isothermal=15 min), in accordance with various embodiments.
Figure 6D:
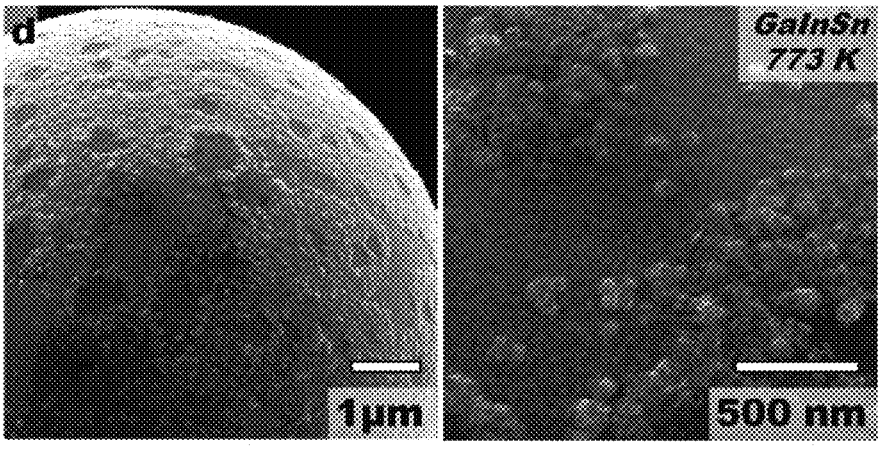
FIG. 6*d* illustrates a micrograph of Galinstan treated at 773 K (t=0), in accordance with various embodiments.

FIGS. 6*a-d* summarizes the fractal-like growth of oxide on Ga-based unary (FIG. 6*a*), binary (FIG. 6*b*), and ternary (FIGS. 6*c* and 6*d*) systems, and show micrographs of particles treated at intermediate temperatures (a) Unary gallium at 773 K (t=0) (b) EGaIn at 773 K (t=0) (c) Galinstan at 673 K (t isothermal=15 min) (d) 773 K (t=0). False colouring is done to highlight surface features from the smooth oxide. Thermal treatment of Ga particles to 773 K leads to wide fractal-like patterns on the surface (FIG. 6*a*). For a binary alloy, eutectic gallium indium (EGaIn, 75.5% Ga, 24.5% In w/w), also treated to 773 K, the fractal patterns are wider than in the unary albeit not containing as much material (not as dense). Extending this to the ternary Galinstan alloy, fractal-like patterns are formed across the surface as fused agglomeration of smaller particles (FIG. 6*d*). To further tune the oxidation on the ternary, particles treated at a slightly lower temperature (673 K) showed web-like fractals (FIG. 6*c*). We can therefore infer that TOCI is not only useful in introducing new surface oxides, but the so-generated oxides can be patterned by adopting known-fractal evolution theories.

Similar processes, while highly stochastic, have been modelled through molecular dynamics experiments following diffusion-limited aggregation mechanism. The formation of these dendritic looking structures depends on surface and adsorbed particle interaction, with the aggregation of formed features dependent on particle-particle interaction. In TOCI, the native surface oxide acts as the plane to which the oxide grows whilst oxygen is the adsorbate which eventually forms the surface oxide. Langmuir adsorption theory describes the probability of oxygen adsorption on the surface to be dependent on the adsorption/desorption ratio. The probability of this event to occur increases as larger area of oxidized surface forms, which subsequently acts as an oxygen capture zone. Pure gallium forms larger aggregated oxide islands due to unrestricted gallium-oxygen interactions. In the alloys, stoichiometry-dependent perturbation of the Ga-oxygen interaction occurs leading to reduced deposition of surface oxide, Adding more components into a system will also increase the underlying sub-oxide layers underneath its passivating oxide, further disrupting diffusion to the surface and the oxidation process. We infer that these perturbation are responsible for the low-volume features on EGaIn and Galinstan. We infer that increasing compositional entropy in an alloy system(s) can be used to dictate fractal patterns and volumetric deposition in TOCI.

Contrast to growth on flat surface which commonly has long branches with a known origin, curved surface displays shorter chains and higher periodicity. An infinitesimal space on the surface of a high curvature spherical particles can be considered flat and thus can act as the source or oxide capture zone for the oxide growth. There are, however, an infinite number of this infinitesimal flat surface around the whole surface, which results in high numbers of oxide growth origins. It is therefore not surprising that the patterns on these particles appear as sintered small particles.

In conclusion, we have demonstrated compositional inversion in a liquid ternary alloy and indirectly confirm interfacial enrichment with formation of passivating oxides. This process leads to thermal-oxidative composition inversion—rendering these 'chameleon' surfaces. Inverse complementarity in surface and bulk composition in fully oxidized particles supports this inference. Tuning the processing temperature leads to size-tunable growth of either spherical particles or cilia-like nanowires on the surface of these particles. Exploiting the underlying TFO mechanism, plastic reconstruction in the liquid, and stoichiometric dependence of chemical reactions, fracture-guided deposition introduced a new fractal-based approach to surface nano-patterning. A combination of these two inferences should inspire design of 'smart' alloy systems that evolve the surface patterns and their composition with temperature (or analogous stimuli) for application ranging from sensing to catalysis.

Figure 7:
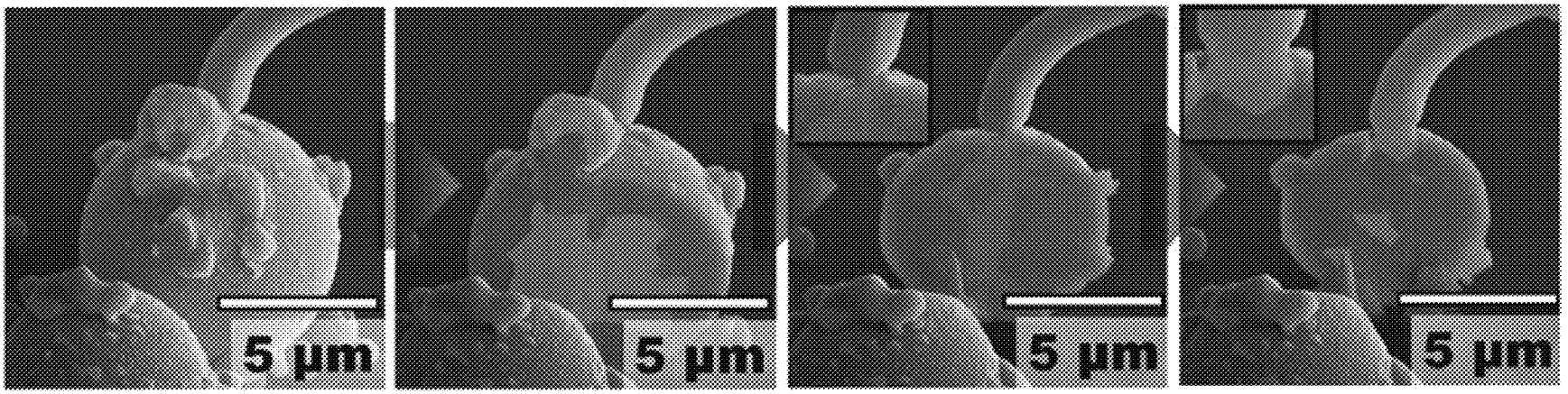
FIG. 7 illustrates a textured particle, in accordance with various embodiments.

FIG. 7 illustrates textured particles formed from starting material core/shell particles derived from metastable Field's metal (including Ti, In, and Sn), formed using the same technique described above. The yellow is Bi that came out after the liquid core solidified.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Exemplary Embodiments

The following exemplary embodiments are provided, the numbering of which is not to be construed as designating levels of importance:

Embodiment 1 provides a textured particle comprising:

an inner core and a spherical solid outer shell comprising an outer surface, wherein the inner core is inside the outer shell, the outer surface comprising a first tier texture comprising a first metal, wherein the first metal is greater than 50 atomic % of a total atomic content of all metals in the first tier texture, a second tier texture comprising the second metal, wherein the second metal is greater than 50 atomic % of a total atomic content of all metals in the second tier texture, and a third tier texture comprising the third metal, wherein the third metal is greater than 50 atomic % of a total atomic content of all metals in the third tier texture;

wherein the first metal, second metal, and third metals are different metals.

Embodiment 2 provides the textured particle of Embodiment 1, wherein the first metal is greater than 70 atomic % of the total atomic content of all metals in the first tier texture.

Embodiment 3 provides the textured particle of any one of Embodiments 1-2, wherein the second metal is greater than 70 atomic % of the total atomic content of all metals in the second tier texture.

Embodiment 4 provides the textured particle of any one of Embodiments 1-3, wherein the third metal is greater than 70 atomic % of the total atomic content of all metals in the third tier texture.

Embodiment 5 provides the textured particle of any one of Embodiments 1-4, wherein the core is hollow.

Embodiment 6 provides the textured particle of any one of Embodiments 1-5, wherein the core comprises a metal composition.

Embodiment 7 provides the textured particle of Embodiment 6, wherein the metal composition in the core comprises a liquid phase.

Embodiment 8 provides the textured particle of any one of Embodiments 6-7, wherein the metal composition in the core comprises a solid phase.

Embodiment 9 provides the textured particle of any one of Embodiments 6-8, wherein the metal composition in the core comprises the third metal, wherein the third metal is greater than 50 atomic % of a total atomic content of the first metal, the second metal, and the third metal in the metal composition.

Embodiment 10 provides the textured particle of any one of Embodiments 6-9, wherein the metal composition in the core has the same composition as the third tier texture.

Embodiment 11 provides the textured particle of any one of Embodiments 1-10, wherein the outer shell comprises the first metal.

Embodiment 12 provides the textured particle of Embodiment 11, wherein the first metal is greater than 50 atomic % of a total atomic content of the first metal, the second metal, and the third metal in the outer shell.

Embodiment 13 provides the textured particle of any one of Embodiments 11-12, wherein the first metal is greater than 70 atomic % of a total atomic content of the first metal, the second metal, and the third metal in the outer shell.

Embodiment 14 provides the textured particle of any one of Embodiments 11-13, wherein the first metal in the outer shell is in the form of an oxide of the first metal.

Embodiment 15 provides the textured particle of any one of Embodiments 11-14, wherein the outer shell has the same composition as the first tier texture.

Embodiment 16 provides the textured particle of any one of Embodiments 1-15, wherein the first metal, the second metal, and the third metals in the first tier texture, second tier texture, and the third tier texture are in the form of an oxide of the first metal, an oxide of the second metal, and an oxide of the third metal.

Embodiment 17 provides the textured particle of any one of Embodiments 1-16, wherein the first metal, the second metal, and the third metals in the first tier texture, second tier texture, and the third tier texture are in the form of nitrides, nitrates, nitrites, organometallics, or a combination thereof, of the first metal, second metal, or the third metal.

Embodiment 18 provides the textured particle of Embodiment 17, wherein the organometallics comprises a carboxylate, an amidate, or a combination thereof.

Embodiment 19 provides the textured particle of any one of Embodiments 1-18, wherein the outer shell excluding the first, second, and third tier textures has a diameter of 0.01 microns to 50 microns.

Embodiment 20 provides the textured particle of any one of Embodiments 1-19, wherein the outer shell excluding the first, second, and third tier textures has a diameter of 0.02 microns to 10 microns.

Embodiment 21 provides the textured particle of any one of Embodiments 1-20, wherein the outer shell excluding the first, second, and third tier textures has a diameter of 1 micron to 5 microns.

Embodiment 22 provides the textured particle of any one of Embodiments 1-21, wherein the combination of the first, second, and third tier textures extend away from the outer core a distance that is 0.1% to 300% of a diameter of the outer shell excluding the first, second, and third tier textures.

Embodiment 23 provides the textured particle of any one of Embodiments 1-22, wherein the combination of the first, second, and third tier textures extend away from the outer core a distance that is 0.5% to 50% of a diameter of the outer shell excluding the first, second, and third tier textures.

Embodiment 24 provides the textured particle of any one of Embodiments 1-23, wherein the combination of the first, second, and third tier textures extend away from the outer core a distance that is 1% to 30% of a diameter of the outer shell excluding the first, second, and third tier textures.

Embodiment 25 provides the textured particle of any one of Embodiments 1-24, wherein the combination of the first, second, and third tier textures extend away from the outer core a distance of 0.1 microns to 50 microns.

Embodiment 26 provides the textured particle of any one of Embodiments 1-25, wherein the combination of the first, second, and third tier textures extend away from the outer core a distance of 0.1 microns to 5 microns.

Embodiment 27 provides the textured particle of any one of Embodiments 1-26, wherein the first tier texture directly contacts the outer shell.

Embodiment 28 provides the textured particle of any one of Embodiments 1-27, wherein the second tier texture directly contacts the outer shell, the first tier texture, or a combination thereof.

Embodiment 29 provides the textured particle of any one of Embodiments 1-28, wherein the second tier texture directly contacts the first tier texture.

Embodiment 30 provides the textured particle of any one of Embodiments 1-29, wherein the third tier texture directly contacts the outer shell, the first tier texture, the second tier texture, or a combination thereof.

Embodiment 31 provides the textured particle of any one of Embodiments 1-30, wherein the third tier texture directly contacts the first tier texture, the second tier texture, or a combination thereof.

Embodiment 32 provides the textured particle of Embodiment 31, wherein the third tier texture is free of direct contact with the outer shell.

Embodiment 33 provides the textured particle of any one of Embodiments 1-32, wherein the third tier texture directly contacts the second tier texture.

Embodiment 34 provides the textured particle of Embodiment 33, wherein the third tier texture is free of direct contact with the outer shell.

Embodiment 35 provides the textured particle of any one of Embodiments 33-34, wherein the third tier texture is free of direct contact with the first tier texture.

Embodiment 36 provides the textured particle of any one of Embodiments 1-35, wherein the first metal, the second metal, and the third metal have different thermal expansivities.

Embodiment 37 provides the textured particle of any one of Embodiments 1-36, wherein the first tier texture, the second tier texture, and the third tier texture have different compositions.

Embodiment 38 provides the textured particle of any one of Embodiments 1-37, wherein the first metal, the second metal, and the third metal are independently chosen from Al, Fe, Cu, Zn, Ga, Ge, Ag, Cd, In, Sn, Sb, Te, Ho, Au, Pb, and Bi.

Embodiment 39 provides the textured particle of any one of Embodiments 1-38, wherein the first metal, the second metal, and the third metal are independently chosen from Ga, In, Sn, Bi, Al, Pb.

Embodiment 40 provides the textured particle of any one of Embodiments 1-39, wherein the first metal is Ga, the second metal is In, and the third metal is Sn.

Embodiment 41 provides the textured particle of any one of Embodiments 1-40, wherein the first metal is In, the second metal is Sn, and the third metal is Bi.

Embodiment 42 provides the textured particle of any one of Embodiments 1-41, wherein the first metal is Bi, the second metal is In, and the third metal is Sn.

Embodiment 43 provides the textured particle of any one of Embodiments 1-42, wherein the first tier texture, second tier texture, third tier texture, or a combination thereof, comprise spheres, nanowires, irregular shapes, a fractal pattern, or a combination thereof.

Embodiment 44 provides the textured particle of any one of Embodiments 1-43, wherein the outer surface further comprises a fourth tier texture comprising a fourth metal, wherein the fourth metal is different than the first metal, second metal, and the third metal, wherein the fourth metal is greater than 50 atomic % of a total atomic content of all metals in the fourth tier texture.

Embodiment 45 provides the textured particle of Embodiment 44, wherein the outer further comprises a firth tier texture comprising a fifth metal, wherein the fifth metal is different than the first metal, second metal, the third metal, and the fourth metal, wherein the fifth metal is greater than 50 atomic % of a total atomic content of all metals in the fifth tier texture.

Embodiment 46 provides a catalyst comprising the textured particle of any one of Embodiments 1-46.

Embodiment 47 provides a tribological device comprising the textured particle of any one of Embodiments 1-46.

Embodiment 48 provides an optical device comprising the textured particle of any one of Embodiments 1-46.

Embodiment 49 provides the optical device of Embodiment 48, wherein the optical device comprises a wave guide, a plasmonic component, or a combination thereof.

Embodiment 50 provides a surface coating comprising the textured particle of any one of Embodiments 1-46.

Embodiment 51 provides the surface coating of Embodiment 50, wherein the surface coating is a corrosion-inhibiting coating.

Embodiment 52 provides a method of using the textured particle of any one of Embodiments 1-46, the method comprising:

using the textured particle as a component of a catalyst, a tribological device, an optical device, a surface coating, or a combination thereof.

Embodiment 53 provides a method of using the textured particle of any one of Embodiments 1-46, the method comprising:

using the textured particle as a catalyst, to inhibit corrosion, to tune surface properties, to tune optical properties, to control wetting of a surface, or a combination thereof.

Embodiment 54 provides a method of forming the textured particle of any one of Embodiments 1-46, the method comprising:

heat treating a starting material particle comprising an inner core comprising the first metal, the second metal, and the third metal; and a solid outer shell comprising an oxide of the first metal.

Embodiment 55 provides the method of Embodiment 54, wherein the first metal, the second metal, and the third metal in the core are a metastable liquid in the core.

Embodiment 56 provides the method of any one of Embodiments 54-55, further comprising forming the starting material particle.

Embodiment 57 provides the method of any one of Embodiments 54-56, wherein the solid outer shell of the starting material particle comprises ($C_1$-$C_{10}$) carboxylate ligands.

Embodiment 58 provides the method of any one of Embodiments 54-57, wherein the solid outer shell of the starting material particle comprises acetate ligands.

Embodiment 59 provides the method of any one of Embodiments 54-58, wherein the heat treating comprises heat treating in an oxidative environment.

Embodiment 60 provides the method of any one of Embodiments 54-59, wherein the heat treating comprises heat treating in a non-oxidizing and/or reducing environment.

Embodiment 61 provides the method of any one of Embodiments 54-60, wherein the heat treating comprises heating the starting material particle to a target temperature of 500 K to 2000 K.

Embodiment 62 provides the method of any one of Embodiments 54-61, wherein the heat treating comprises heating the starting material particle to a target temperature of 750 K to 1500 K.

Embodiment 63 provides the method of any one of Embodiments 54-62, wherein the heat treating comprises heating the starting material particle to a target temperature of 1000 K to 1300 K.

Embodiment 64 provides the method of any one of Embodiments 61-63, wherein the heat treating comprises maintaining the starting material particle at the target temperature for 0.1 min to 1 day.

Embodiment 65 provides the method of any one of Embodiments 61-64, wherein the heat treating comprises maintaining the starting material particle at the target temperature for 1 min to 2 h.

Embodiment 66 provides the textured particle, catalyst, tribological device, optical device, surface coating, or method of Embodiments 1-65 optionally configured such that all elements or options recited are available to use or select from.

What is claimed is:

1. A textured particle comprising:

an inner core; and a spherical solid outer shell comprising an outer surface, wherein the inner core is inside the outer shell, the outer shell comprises a first tier texture between the outer surface and the inner core, the first tier texture comprising a first metal that is greater than 50 atomic % of a total atomic content of all metals in the first tier texture, wherein the first tier texture comprises cracks between the outer surface and the inner core, and the outer surface comprises a second tier texture comprising a second metal, wherein the second metal is greater than 50 atomic % of a total atomic content of all metals in the second tier texture, and a third tier texture comprising a third metal, wherein the third metal is greater than 50 atomic % of a total atomic content of all metals in the third tier texture;

wherein the first metal, second metal, and third metals are different metals, and wherein the second tier texture is on the cracks in the first tier texture, and the third tier texture is on a surface of the second tier texture.

2. The textured particle of claim 1, wherein the core comprises a metal composition, wherein the metal composition in the core comprises the third metal, wherein the third metal is greater than 50 atomic % of a total atomic content of the first metal, the second metal, and the third metal in the metal composition.

3. The textured particle of claim 1, wherein the first metal is greater than 50 atomic % of a total atomic content of the first metal, the second metal, and the third metal in the outer shell.

4. The textured particle of claim 1, wherein the first metal, the second metal, and the third metals in the first tier texture, second tier texture, and the third tier texture are in the form of an oxide of the first metal, an oxide of the second metal, and an oxide of the third metal.

5. The textured particle of claim 1, wherein the first metal, the second metal, and the third metals in the first tier texture, second tier texture, and the third tier texture are in the form of nitrides, nitrates, nitrites, organometallics, or a combination thereof, of the first metal, second metal, or the third metal.

6. The textured particle of claim 1, wherein the textured particle has a diameter of 0.11 microns to 100 microns.

7. The textured particle of claim 1, wherein the textured particle has a diameter of 1.1 microns to 10 microns.

8. The textured particle of claim 1, wherein the combination of the first, second, and third tier textures extend away from the inner core a distance of 0.1 microns to 50 microns.

9. The textured particle of claim 1, wherein the first metal, the second metal, and the third metal are independently chosen from Al, Fe, Cu, Zn, Ga, Ge, Ag, Cd, In, Sn, Sb, Te, Ho, Au, Pb, and Bi.

10. The textured particle of claim 1, wherein the first metal, the second metal, and the third metal are independently chosen from Ga, In, Sn, Bi, Al, Pb.

11. The textured particle of claim 1, wherein the first metal is Ga, the second metal is In, and the third metal is Sn.

12. The textured particle of claim 1, wherein the first metal is In, the second metal is Sn, and the third metal is Bi, or wherein the first metal is Bi, the second metal is In, and the third metal is Sn.

13. The textured particle of claim 1, wherein the second tier texture, third tier texture, or a combination thereof, comprises spheres, nanowires, irregular shapes, a fractal pattern, or a combination thereof.

14. A catalyst, tribological device, optical device, or surface coating comprising the textured particle of claim 1.

15. A method of using the textured particle of claim 1, the method comprising:

using the textured particle as a component of a catalyst, a tribological device, an optical device, a surface coating, or a combination thereof.

16. A method of using the textured particle of claim 1, the method comprising:

using the textured particle as a catalyst, to inhibit corrosion, to tune surface properties, to tune optical properties, to control wetting of a surface, or a combination thereof.

17. A method of forming the textured particle of claim 1, the method comprising: heat treating a starting material particle comprising an inner core comprising the first metal, the second metal, and the third metal; and a solid outer shell comprising an oxide of the first metal.

18. The method of claim 17, wherein the first metal, the second metal, and the third metal in the core are a metastable liquid in the core of the starting material particle.

19. The textured particle of claim 1, wherein the second tier texture is concentrated on the cracks in the first tier texture.

20. A textured particle comprising:

an inner core; and a spherical solid outer shell comprising an outer surface, wherein the inner core is inside the outer shell, the outer surface comprising a first tier texture comprising a first metal that is Ga, wherein the first metal is greater than 50 atomic % of a total atomic content of all metals in the first tier texture, a second tier texture comprising a second metal that is In, wherein the second metal is greater than 50 atomic % of a total atomic content of all metals in the second tier texture, and a third tier texture comprising a third metal that is Sn, wherein the third metal is greater than 50 atomic % of a total atomic content of all metals in the third tier texture;

wherein the first metal, second metal, and third metals are different metals, and wherein the first tier texture, second tier texture, third tier texture, or a combination thereof, comprise nanowires, irregular shapes, a fractal pattern, or a combination thereof.

* * * * *